US006949180B2

(12) United States Patent
Krug et al.

(10) Patent No.: US 6,949,180 B2
(45) Date of Patent: Sep. 27, 2005

(54) LOW TOXICITY FISCHER-TROPSCH DERIVED FUEL AND PROCESS FOR MAKING SAME

(75) Inventors: Russell R. Krug, Novato, CA (US); Stephen J. Miller, San Francisco, CA (US); Russell D. White, Richmond, CA (US); David R. Johnson, Petaluma, CA (US); Christopher A. Simmons, El Cerrito, CA (US); James Arthur Rutherford, San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/625,011

(22) Filed: Jul. 22, 2003

(65) Prior Publication Data

US 2004/0124121 A1 Jul. 1, 2004

Related U.S. Application Data

(60) Provisional application No. 60/417,509, filed on Oct. 9, 2002.

(51) Int. Cl.[7] ..... C10L 1/04

(52) U.S. Cl. ..... 208/15; 208/17; 208/950; 585/1; 585/14

(58) Field of Search ..... 208/15, 17, 950; 585/14

(56) References Cited

U.S. PATENT DOCUMENTS

| | | | | | |
|---|---|---|---|---|---|
| 4,044,064 | A | * | 8/1977 | Milstein et al. | 208/79 |
| 4,071,574 | A | * | 1/1978 | Milstein et al. | 208/57 |
| 4,919,786 | A | * | 4/1990 | Hamner et al. | 208/27 |
| 5,378,348 | A | * | 1/1995 | Davis et al. | 208/27 |
| 5,689,031 | A | * | 11/1997 | Berlowitz et al. | 585/734 |
| 5,807,413 | A | * | 9/1998 | Wittenbrink et al. | 44/451 |
| 5,895,506 | A | * | 4/1999 | Cook et al. | 585/734 |
| 6,179,994 | B1 | * | 1/2001 | Clark et al. | 208/27 |
| 6,309,432 | B1 | * | 10/2001 | Wittenbrink et al. | 44/436 |
| 6,475,375 | B1 | * | 11/2002 | Dancuart | 208/78 |
| 6,607,568 | B2 | * | 8/2003 | Wittenbrink et al. | 44/451 |
| 6,755,961 | B1 | * | 6/2004 | Berlowitz et al. | 208/15 |
| 6,765,025 | B2 | * | 7/2004 | Ding et al. | 518/715 |

FOREIGN PATENT DOCUMENTS

| | | |
|---|---|---|
| GB | 2 166 782 A | 5/1986 |
| SU | 1816792 | 5/1993 |
| WO | WO 02/07068 B2 | 1/2002 |

OTHER PUBLICATIONS

Baxter, C.S. et al., Mechanism of Mouse Skin Tumor Promotion by N–Dodecane, Carcinogenesis, vol. 8, No. 12, pp. 1787–1790 (1987).

Freeman, J.J. et al., A 90–Day Toxicity Study of the Effects of Petroleum Middle Distillates on the Skin of C3H Mice, Toxicology and Industrial Health, vol. 6, No. 3/4, pp. 475–491 (1990).

(Continued)

*Primary Examiner*—Ellen M. McAvoy
(74) *Attorney, Agent, or Firm*—James W. Ambrosius; Susan Abernathy

(57) ABSTRACT

A method for preparing low toxicity Fischer-Tropsch fuels suitable for use in a diesel engine and Fischer-Tropsch derived fuel compositions having low toxicity suitable for use in diesel engines characterized by a boiling range distribution wherein the 5 weight percent point is at a temperature of 570 degrees F. or less and the 95 weight percent point is at or above a temperature of 680 degrees F.; a kinematic viscosity at 40 degrees C. of less than 5.5 cSt; and a cloud point of less than −18 degrees C.

10 Claims, 5 Drawing Sheets

OTHER PUBLICATIONS

Freeman, J.J. et al., Evaluation of the Contribution of Chronic Skin Irritation and Selected Compositional Parameters to the Tumorigenicity of Petroleum Middle Distillates in Mouse Skin, Toxicology, vol. 81, pp. 103–112 (1993).

Nessel, C.S. et al., A Comprehensive Evaluation of the Mechanism of Skin Tumorigenesis by Straight–Run and Cracked Petroleum Middle Distillates, Toxicological Science, vol. 44, pp. 22–31 (1999).

Walborg, E.F. et al., Short–term Biomarkers of Tumor Promotion in Mouse Skin Treated With Petroleum Middle Distillates, Toxicological Sciences, vol. 45, pp. 137–145 (1998).

Nessel, C.S. et al., The Role of Dermal Irritation in the Skin Tumor Promoting Activity of Petroleum Middle Distillates, Toxicological Science, vol. 49, pp. 48–55 (1999).

William D. Broddle, et al., "Chronic Dermal Studies of Petroleum Streams In Mice", Fundamental and Applied Toxicology 30 (1996) pp. 47–54.

Chi–Chung Chou, et al., "Differential Relationship between the Carbon Chain Length of Jet Fuel Aliphatic Hydrocarbons and Their Ability to Induce Cytotoxicity vs. Interleukin–8 Release in Human Epidermal Keratinocyles", Toxicological Sciences 69 (2002) pp. 228–233.

* cited by examiner

Unimodal Boiling Point Distribution

Bimodal Boiling Point Distribution

LOW TOXICITY FISCHER-TROPSCH DERIVED FUEL AND PROCESS FOR MAKING SAME

CROSS REFERENCE TO RELATED APPLICATION

The application claims priority from U.S. Provisional Patent Application No. 60/417,509 filed Oct. 9, 2002.

FIELD OF THE INVENTION

The invention relates to a fuel composition suitable for use in a diesel engine which has lower toxicity than conventional fuels boiling within the range of diesel and a process for making such compositions.

BACKGROUND OF THE INVENTION

Liquid hydrocarbon based fuels, such as gasoline and diesel fuel, are known to display a certain degree of toxicity when contacted with biological systems. For example, the toxicological effects of fuels on mice were reported by C. S. Baxter and M. L. Miller in an article titled "Mechanism of Mouse Tumor Promotion by N-Dodecane", Carcinogenesis, Vol. 8, pages 1787–1790 (1987) and by Walborg et al. in an article titled "Short-term Biomarkers of Tumor Promotion in Mouse Skin Treated with Petroleum Middle Distillates", Toxicological Sciences, Vol. 45, pages 137–145 (1998). See also "A 90-Day Toxicity Study of the Effects of Petroleum Middle Distillates on the Skin of C3H Mice" by James J. Freeman et al. in Toxicology and Industrial Health Vol. 6; 3/4, pages 475–491 (1990) and "The Role of Dermal Irritation in the Skin Tumor Promoting Activity of Petroleum Middle Distillates" by Craig S. Nessel et al., Toxicological Sciences, Vol.49, pages 48–55 (1999). Walborg et. al. used as a biomarker chemically induced epidermal hyperplasia in mice. In their tests, the increase in epidermal thickness observed after repeated treatments of mice over a two week period was evaluated. This test is a relatively rapid and cost-effective method for determining the biological activity of transportation fuels when applied topically.

Transportation fuels having lowered biological activity are highly desirable; however, few practical methods for manufacturing transportation fuels which display reduced toxicity have been reported. Studies have suggested that mineral oil when mixed with petroleum-derived middle distillates is able to reduce the skin irritation in mice. See J. J. Freeman et al. "Evaluation of the Contribution of Chronic Skin Irritation and Selected Compositional Parameters to the Tumorigenicity of Petroleum Middle Distillates in Mouse Skin" Toxicology, Vol. 81, pages 103–112 (1993) and Craig S. Nessel et al. "A Comprehensive Evaluation of the Mechanism of Skin Tumorigenesis by Straight-Run and Cracked Petroleum Middle Distillates" Toxicological Sciences, Vol. 44, pages 22–31 (1998).

The present invention is directed to a transportation fuel, suitable for use in a diesel engine which, using the methods described in Walborg et al., will display a reduced level of toxicity as evidenced by the difference between the epidermal thickness in mice treated with the fuel composition as compared to controls. The invention is also directed to a process for preparing the lowered toxicity transportation fuels of the invention.

For the purpose of this disclosure the term "transportation fuels" refers to a liquid transportation fuel. Generally, liquid transportation fuels will refer to fuels boiling within the range of gasoline, jet, or diesel. However, as will be explained in greater detail further on in this disclosure, the unique fuel compositions of this invention may have a boiling range outside of the boiling ranges of conventional transportation fuels. Fuel compositions of the present invention are particularly suitable for use as fuel in diesel engines.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" are intended as a transition meaning the exclusion of all but the recited elements with the exception of only minor traces of impurities.

SUMMARY OF THE INVENTION

The present invention is directed to a liquid transportation fuel which is especially suitable for use in a diesel engine. More specifically the invention is directed to a Fischer-Tropsch derived fuel composition characterized by a boiling range distribution when measured by ASTM D2887 or its equivalent wherein the 5 weight percent point of the boiling range distribution is at a temperature of about 570 degrees F. or less and the 95 weight percent point of the boiling range distribution is at or above a temperature of about 680 degrees F.; a kinematic viscosity at 40 degrees C. of less than about 5.5 cSt; and a cloud point of less than about −18 degrees C. Preferably, the 95 weight percent point of the boiling range distribution of the fuel composition will be at or above a temperature of about 730 degrees F. and more preferably the 95 weight percent point will be a temperature at or above about 850 degrees F. Typically, the boiling range distribution of the composition will have the 5 weight percent point at or above about 250 degrees F., preferably at or above about 300 degrees F., and most preferably at or above about 350 degrees F. In this disclosure when referring to boiling range distribution, the boiling range between the 5 percent and 95 percent boiling points is what is referred to. All boiling range distributions in this disclosure are measured using the standard analytical method D2887 or its equivalent unless stated otherwise. As used herein, an equivalent analytical method to D2887 refers to any analytical method which gives substantially the same results as the standard method.

The fuel compositions of the present invention preferably contain a reduced proportion of that intermediate boiling fraction having a boiling range between about 400 degrees F. and about 650 degrees F. preferably that fraction boiling between about 450 degrees F. and about 600 degrees F., and most preferably that fraction boiling between about 500 degrees F. and about 600 degrees F. In one embodiment of the present invention, this intermediate fraction should comprise no more 30 weight percent of the entire fuel composition, preferably no more than 25 weight percent, more preferably no more than 20 weight percent, even more preferably no more than 15 weight percent, and most preferably no more than 10 weight percent. This intermediate fraction has been found to promote epidermal hyperplasia in mice which is indicative of biological toxicity upon topical application. As a result of the proportional reduction or absence of this intermediate boiling fraction, fuel compositions of the present invention may display a bimodal boiling range distribution.

Bi-modal boiling range distribution as used in this disclosure refers to a boiling range distribution for a Fischer- Tropsch derived fuel composition of the present invention as measured by ASTM D-2887 which when plotted on a graph displays at least two major aggregates or a plateau between aggregates indicating the absence or significant reduction of a hydrocarbon fraction boiling between about 500 degrees F. and about 650 degrees F. The term "aggregates" refers to collections of hydrocarbon molecules of similar boiling range. A typical transportation fuel has a uni-modal distillation pattern and when plotted on a graph displays a pattern similar to a normal Gaussian curve. A bi-modal boiling range distribution when plotted on a graph displays a pattern similar to two overlapping Gaussian curves. Typical uni-modal and bi-modal boiling range distributions for a Fischer-Tropsch derived transportation fuel are illustrated in FIG. 1 and FIG. 2, respectively.

The present invention may also be practiced by a process for preparing a Fischer-Tropsch derived fuel composition suitable for use in a diesel engine which comprises (a) recovering a Fischer-Tropsch derived transportation fuel product; (b) separating the Fischer-Tropsch derived transportation fuel product into at least a high boiling fraction, an intermediate boiling fraction, and a low boiling fraction, wherein the intermediate boiling fraction contains at least 70 weight percent of the hydrocarbons present in the Fischer-Tropsch derived transportation fuel product boiling between about 400 degrees F. and about 650 degrees F.; and (c) blending together the high boiling fraction and the low boiling fraction whereby a Fischer-Tropsch derived transportation fuel composition characterized by a bi-modal boiling range distribution is produced that is suitable for use in a diesel engine. In practicing this embodiment of the invention preferably at least 90 weight percent of the hydrocarbons in the Fischer-Tropsch derived transportation fuel product boiling between about 500 degrees F. and about 650 degrees F. will be included in the intermediate fraction.

As used herein the term "conventional fuel" refers to both petroleum derived fuel compositions and Fischer-Tropsch derived fuel compositions having a defined boiling range falling between the initial boiling point and the endpoint (upper boiling point) that is generally specified for that particular transportation fuel. However, since the initial boiling point and endpoint do not accurately reflect the boiling range distribution, for the purpose of this disclosure the 5 weight percent and 95 weight percent points of the boiling range distribution as measured by ASTM D2887 or its equivalent are used. In the case of diesel, the 5 weight percent point is generally specified as about 320 degrees F. or above and the 95 weight percent point is specified as about 680 degrees F. Thus fuel compositions of the present invention will be seen generally to have the 95 weight percent point of the boiling range distribution higher, preferably significantly higher, than the 95 weight percent point of the boiling range distribution of conventional diesel. However, due to the unique properties of Fischer-Tropsch fuel compositions of the invention, they are suitable for use in diesel engines.

Fuel compositions falling within the boiling range distribution of conventional diesel may also be included within the scope of the invention if the intermediate diesel fraction boiling between about 400 degrees F. and about 650 degrees F. is significantly reduced or absent. In this embodiment the 95 weight percent point of the boiling range distribution for the high boiling diesel fraction may be at or above a temperature of about 630 degrees F. when measured by ASTM D2887 or its equivalent. The lower upper boiling point is possible while retaining the advantages of lower toxicity due to relative absence of the intermediate boiling fraction. Such diesel fuel compositions usually will have a bi-modal boiling range distribution due to the absence of the intermediate diesel fraction. The intermediate diesel fraction may be recycled for further processing.

It has also been found that higher boiling fractions of the Fischer-Tropsch derived-fuel appear to mitigate the toxic effects of the intermediate boiling fraction. Thus by increasing the proportion of the higher boiling fraction, especially that fraction boiling above about 750 degrees F., the toxicity of the overall composition, even with the intermediate boiling fraction intact, is significantly reduced. The fraction boiling above about 800 degrees F. is particularly effective in reducing the toxicity of the overall composition. For example, when tested using the Walborg et al. method for evaluating topical toxicity (see Example 1) fuel compositions containing 30 weight percent or more of 800 degree F. hydrocarbons display very low toxicity in mice as compared to controls.

Fuel compositions of the present invention have been shown to display a lower toxicity when in contact with a biological system than those fuel compositions which boil within the range of conventional diesel. As will be discussed later, the lowered toxicity is evidenced by comparing the epidermal thickening of mice treated with fuels of the present invention against control mice treated with conventional Fischer-Tropsch diesel fuel while using the method of Walborg et al.

DETAILED DESCRIPTION OF THE INVENTION

Figure 1:
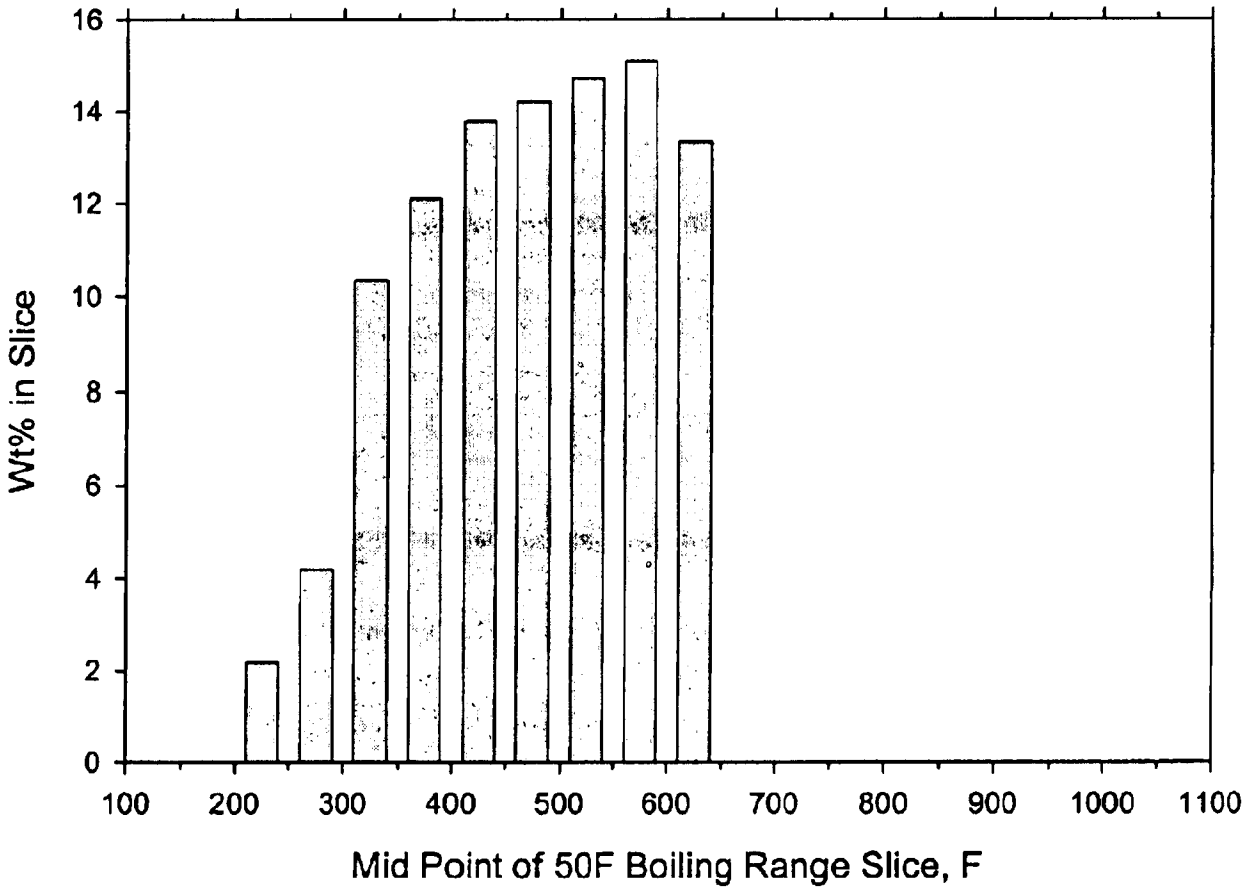
FIG. 1 shows a typical uni-modal boiling range distribution for a Fischer-Tropsch transportation fuel in which the mid boiling point of various cuts (50 degree F. slices) are graphed against the weight percent of the cut in the total weight of fuel.
Figure 2:
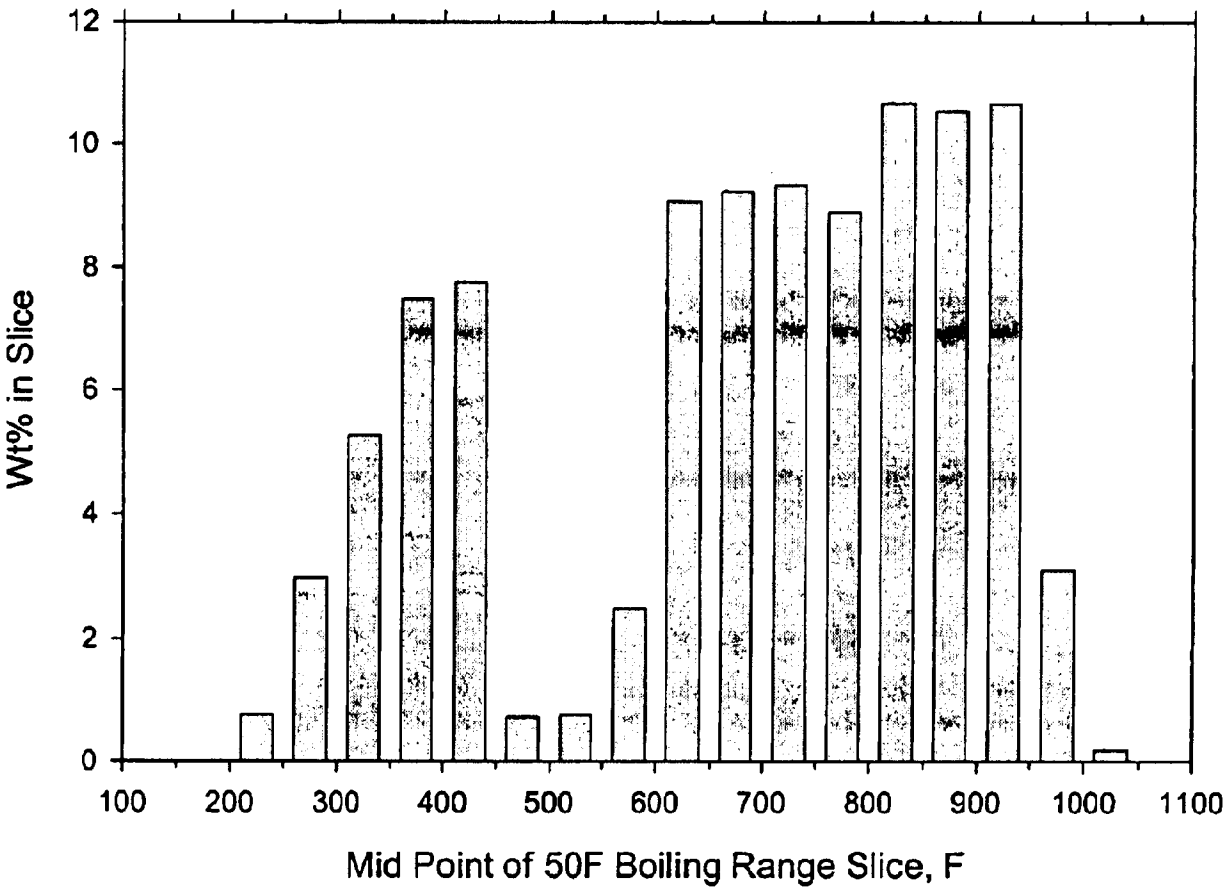
FIG. 2 shows a typical bi-modal boiling range distribution for a Fischer-Tropsch transportation fuel in which the mid boiling point of various cuts (50 degree F. slices) are graphed against the weight percent of the cut in the total weight of fuel.

Surprisingly, experimental data suggests Fischer-Tropsch fuel compositions characterized by a boiling range distribution in which the 95 weight percent point of the boiling range distribution is above about 680 degrees F. have a lower toxicity than similar fuel compositions having the 95 weight percent point below 680 degrees F. Accordingly, compositions characterized by having the 95 weight percent point above about 730 degrees F. are preferred, above about 750 degrees F. being more preferred, above about 780 degrees F. being even more preferred, above about 800 degrees F. being even more preferred, and a 95 weight percent point above about 850 degrees F. being most preferred. The upper limit on the temperature of the 95 weight percent point of the boiling range distribution will be controlled by engine performance or environmental considerations, such as the production of unacceptable amounts of particulate matter in the exhaust from the diesel engine when the fuel composition is used.

As will be more fully explained below, the data suggest that a toxic effect is present in certain intermediate boiling fractions of the fuel, especially that fraction boiling between about 500 degrees F. and about 600 degrees F. While not wishing to be bound by any particular mechanism when defining the scope of the invention, it is speculated that the higher boiling fractions may help reduce or minimize the toxic effect or otherwise reduce its potency, possibly through dilution. For example, it has been found that a fuel cut made up primarily of $C_{16}$ hydrocarbons displayed significantly increased toxicity as compared to both higher and lower boiling fractions. Test data suggests that fuel cuts having a boiling range between about 400 degrees F. and about 650 degrees F., more likely between about 450 degrees F. and about 600 degrees F., and most likely between about 500 degrees F. and about 600 degrees F., may contain a component which induces epidermal hyperplasia in mice. For this reason, it is preferred that the intermediate fraction boiling within these ranges comprise no more than 30 weight percent of the entire fuel composition, preferably no more than 25 weight percent, more preferably no more than 20 weight percent, even more preferably no more than 15 weight percent, and most preferably no more than 10 weight percent.

The Fischer-Tropsch derived transportation fuels of the present invention, despite having a boiling range distribution with the 95 weight percent point at or above about 680 degrees F., are suitable for use as a fuel in diesel engines. This is due to the favorable properties of Fischer-Tropsch derived products generally. Fischer-Tropsch derived fuel compositions of the present invention have a viscosity of not more than about 5.5 cSt, preferably not more than about 4.1 cSt, at 40 degrees C., and a cloud point of less than about −18 degrees C., preferably less than about −25 degrees C., and most preferably less than about −30 degrees C. In addition, due to the low sulfur, preferably below about 5 ppm, and high isoparaffin content, a fuel may be prepared that can be burned in diesel engines with low particulate emissions despite having the temperature of 95 weight percent point of the boiling range distribution in excess of that for conventional diesel fuels. The reduction of diesel particulate emissions is a major initiative in the industry to improve the toxicity of post combustion products. The viscosity and cloud point of fuel compositions of the invention are within the general specifications for fuels suitable for use in diesel engines. Although the 95 weight percent point of the boiling range distribution is higher than that generally accepted for petroleum derived diesel fuels, the unique properties of the fuels of the invention renders them suitable for use in diesel engines.

Since Fischer-Tropsch derived materials tend to be highly paraffinic, in order to achieve the target values for viscosity and cloud point, it is usually necessary to increase the iso-paraffin content of the transportation fuel of the present invention before it is suitable for use as fuel for a diesel engine. Generally, this will involve hydrocracking plus dewaxing of either the transportation fuel or its precursor. The dewaxing process may be a solvent or a catalytic process, however, catalytic dewaxing is generally preferred, especially preferred is hydroisomerization. Hydrocracking and dewaxing may be done as separate steps or may be done using a multifunctional hydroisomerization hydrocracking catalyst or catalyst system that can produce a low cloud point fuel product.

Hydrocracking refers to a catalytic process, usually carried out in the presence of free hydrogen, in which the cracking of the larger hydrocarbon molecules is the primary purpose of the operation. Desulfurization and/or denitrogenation of the feedstock also usually will occur. The hydrocracking unit may be either once-through or recycle configuration. In recycle hydrocracking a fraction of the cracked hydrocarbons, generally a heavy fraction or bottoms, is recycled to the hydrocracking reactor. Several different recycle configurations are used commercially, any of which would be suitable for producing fuel compositions of the present invention. Suitable configurations include single-stage recycle and two-stage recycle. However, with the present invention, single-stage recycle is generally preferred, since the initial capital cost is lower than that for the other configuration, and two-stage recycle does not offer any advantages over single-stage recycle when the hydrocarbons being processed are derived from a Fischer-Tropsch operation. In carrying out the recycle hydrocracking operation, the process is preferably operated to extinction. That is, all of the unconverted reactor effluent (boiling above the fuel endpoint) is recycled back to the reactor inlet. There may be an optional small recycle bleed stream to reduce the buildup of refractory material, such as polycyclic aromatics.

Catalysts used in carrying out the hydrocracking operation are well known in the art. See for example U.S. Pat. Nos. 4,347,121 and 4,810,357, the contents of which are hereby incorporated by reference in their entirety, for general descriptions of the hydrocracking process, and of typical catalysts used in the process. Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to the matrix component by co-mulling, impregnation, or ion exchange and the Group VIB components, e.g.; molybdenum and tungsten, can be combined with the refractory oxide by impregnation, co-mulling or co-precipitation.

The matrix component can be of various types including some that have acidic catalytic activity to provide hydroisomerization and dewaxing. Matrices that have activity include amorphous silica-alumina or preferably zeolitic or non-zeolitic crystalline molecular sieves. Examples of suitable matrix molecular sieves include SSZ-32, ZSM-22, ZSM-23, zeolite Beta, zeolite Y, zeolite X, the so called ultra stable zeolite Y, and high structural silica-alumina ratio zeolite Y such as that described in U.S. Pat. Nos. 4,401,556; 4,820,402 and 5,059,567. Small crystal size zeolite Y, such as that described in U.S. Pat. No. 5,073,530, can also be used. Non-zeolitic molecular sieves which can be used include, for example silicoaluminophosphates (SAPO), ferroaluminophosphate, titanium aluminophosphate and the various ELAPO molecular sieves described in U.S. Pat. No. 4,913,799 and the references cited herein. Details regarding the preparation of various non-zeolite molecular sieves can be found in U.S. Pat. Nos. 5,114,563 (SAPO) and 4,913,799 and in the various references cited in U.S. Pat. No. 4,913,799. Mesoporous molecular sieves can also be used, as for example the M41S family of materials as described in J. Am. Chem. Soc., 114:10834–10843 (1992)), MCM41; U.S. Pat. Nos. 5,246,689; 5,198,203; and 5,334,368; and MCM-48 (Kresge et al., Nature 359:710 (1992)). Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaoline families. These clays can be used in the raw state as originally mined or initially subjected to calumniation, acid treatment or chemical modification.

Furthermore, more than one catalyst type may be used in the reactor. The different catalyst types can be separated into layers or mixed. Typical hydrocracking conditions vary over a wide range. In general, the overall LHSV is between about 0.1 $hr^{-1}$ to about 15.0 $hr^{-1}$ (v/v), preferably from about 0.25 $hr^{-1}$ to about 2.5 $hr^{-1}$. The reaction pressure generally ranges from about 500 psia to about 3500 psig (about 10.4 MPa to about 24.2 MPa), preferably from about 1000 psig to about 2000 psig (about 3.5 MPa to about 34.5 MPa). Hydrogen consumption is typically from about 500 to about 2500 SCF per barrel of feed (89.1 to 445 $m^3$ H2/$m^3$ feed). Temperatures in the reactor will range from about 400 degrees F. to about 950 degrees F. (about 204 degrees C. to about 510 degrees C.), preferably ranging from about 600 degrees F. to about 800 degrees F. (about 315 degrees C. to about 427 degrees C.).

Catalytic dewaxing when practiced as part of the present invention usually will be either by conventional hydrodewaxing or complete hydroisomerization dewaxing. Both types of dewaxing involve passing a mixture of a waxy hydrocarbon stream and hydrogen over a catalyst that contains an acidic component to convert the normal and slightly branched iso-paraffins in the feed to other non-waxy species with acceptable properties. Typical conditions for both dewaxing processes involve temperatures from about 400 degrees F. to about 800 degrees F. (about 200 degrees C. to about 425 degrees C.), pressures from about 200 psig to 3000 psig, and space velocities from about 0.2 to 5 $hr^{-1}$. The method selected for dewaxing a feed typically depends on the product quality, and the wax content of the feed, with conventional hydrodewaxing often preferred for low wax content feeds. The method for dewaxing can be effected by the choice of the catalyst. The determination between conventional hydrodewaxing and complete hydroisomerization dewaxing can be made by using the n-hexadecane isomerization test as described in U.S. Pat. No. 5,282,958. When measured at 96 percent, n-hexadecane conversion using conventional hydrodewaxing catalysts will exhibit a selectivity to isomerized hexadecanes of less than 10 percent while complete hydroisomerization dewaxing catalysts will exhibit a selectivity to isomerized hexadecanes of greater than or equal to 40 percent, preferably greater than 60 percent, and most preferably greater than 80 percent.

In conventional hydrodewaxing the pour point and cloud point are lowered by selectively cracking the wax molecules mostly to smaller paraffins using a conventional hydrodewaxing catalyst, such as, for example ZSM-5. Metals may be added to the catalyst, primarily to reduce fouling.

Complete hydroisomerization dewaxing typically achieves high conversion levels of wax by isomerization to non-waxy iso-paraffins while at the same time minimizing the conversion by cracking. Complete hydroisomerization dewaxing uses a dual-functional catalyst consisting of an acidic component and an active metal component having hydrogenation activity. Both components are required to conduct the isomerization reaction. The acidic component of the catalysts used in complete hydroisomerization preferably includes an intermediate pore SAPO, such as SAPO-11, SAPO-31, and SAPO-41, with SAPO-11 being particularly preferred. Intermediate pore zeolites, such as ZSM-22, ZSM-23, and SSZ-32, also may be used in carrying out complete hydroisomerization dewaxing. Typical active metals include molybdenum, nickel, vanadium, cobalt, tungsten, zinc, platinum, and palladium. The metals platinum and palladium are especially preferred as the active metals, with platinum most commonly used.

Various tests are available to evaluate the toxicity of a fuel composition. In the present instance, toxicity resulting from topical contact with a higher animal was used to access the relative toxicity of the different fuel compositions. More specifically, the toxicity of the fuel compositions was tested using the general technique of Walborg et al. In general, this method uses increases in the epidermal thickness and the labeling index of epidermal cell, referred to as chemically induced epidermal hyperplasia, as indicia of topical toxicity.

The following examples are intended to further clarify the invention but are not to be construed as a limitation thereon.

EXAMPLES

Example 1

General Testing Protocol for Evaluating Toxicity in Mice

The general protocol for carrying out the mouse tests referred to in this disclosure used the general method described in Walborg et al. "Short-term Biomarkers of Tumor Promotion in Mouse Skin Treated with Petroleum Middle Distillates", Toxicological Sciences, Vol. 45. pages 137–145 (1998). The method may be summarized as follows:

Female Crl:CD-1® (ICR) BR mice (approximately 5–6 weeks of age) were received from Charles River Laboratories, Portage, Mich. The animals were housed 3–4 per cage for several days to allow time to adapt to the automatic watering system. Subsequently, the animals were caged individually in suspended, stainless steel, wire mesh-type cages. During the approximately 2 week acclimation period, all mice were observed daily for clinical signs of disease and given a detailed clinical examination prior to selection for study.

Prior to assignment to study groups, each mouse was examined for evidence of disease or other physical abnormalities. Animals considered suitable for study were weighed prior to treatment and randomized into treatment groups using a standard, by weight, block randomization procedure. There was one group of 10 mice per test sample, and one group of 10 mice for a sham control group. Animals were treated on Study Days 1, 4, 9, and 13, and euthanized and necropsied on Study Day 15. Animals in the sham control were maintained and observed in the same manner as the test group animals, but were not dosed.

The mice were individually housed in suspended, stainless steel, wire mesh-type cages. Fluorescent lighting was provided for approximately 12 hours per day and controlled by an automatic timer. Temperature and humidity were maintained between 66–72 F and 43–69 percent.

Certified Rodent Chow® #5002 (PMI Nutrition International, Inc., St. Louis, Mo.) was available ad libitum. Water was available ad libitum using an automatic watering system.

The hair was clipped with an electric clipper from the interscapular to the pelvic region of the back of each animal approximately 24 hours before the start of treatment. During the study, the hair was reclipped a minimum of once per week. Animals were not clipped on a treatment day; hair was clipped at least 18 hours before dosing. Care was taken to avoid abrasion of the skin during hair removal, and the clipper blades were thoroughly rinsed in 70 percent ethanol between groups. The test sample was taken up in an Eppendorf repeat pipetter set at 100 $\mu$l and discharged onto the target dose site. Gentle inunction with a glass stirring rod was used to evenly distribute the test sample over the prescribed dosing area. A clean stirring rod was used for each test group. The corners of the application site were marked with indelible ink to help assure the appropriate area was taken at necropsy.

BrdU (5-bromo-2-deoxyuridine) was dissolved in sterile phosphate-buffered saline (pH 7.0) on the morning of use. The target dose was 150 mg/kg administered by intraperitoneal injection at a dose volume of 10 mL/kg. Animals were dosed 60–75 minutes prior to euthanasia.

Necropsy examinations were limited to the treated skin. Treated skin samples and a sample of duodenum were collected from each animal, preserved in formalin, processed into paraffin blocks, and sent for pathology evaluation.

Sections of the skin were examined microscopically. A section of duodenum, a tissue with high cell proliferative rate, was included on each slide to confirm systemic delivery of BrdU. If positive staining for BrdU was absent or suboptimal in the duodenum, the skin from that animal was not evaluated for cell proliferation. Proliferation of the epidermal cells was measured as a function of the number of epidermal cells incorporating BrdU into their DNA. Parameters evaluated on the skin samples of each animal were BrdU labeling indices (percentage of labeled cells), epidermal thickness (basal lamina up to and including the stratum corneum), nucleated cell/100 $\mu$m basement membrane, and histopathology composite scores for epidermis and dermis.

The BrdU cell labeling index is a measure of the cell proliferation rate at the end of the test. Epidermal thickness is a measure of the cumulative cell proliferation that took place during the course of the test.

Example 2

Figure 3:
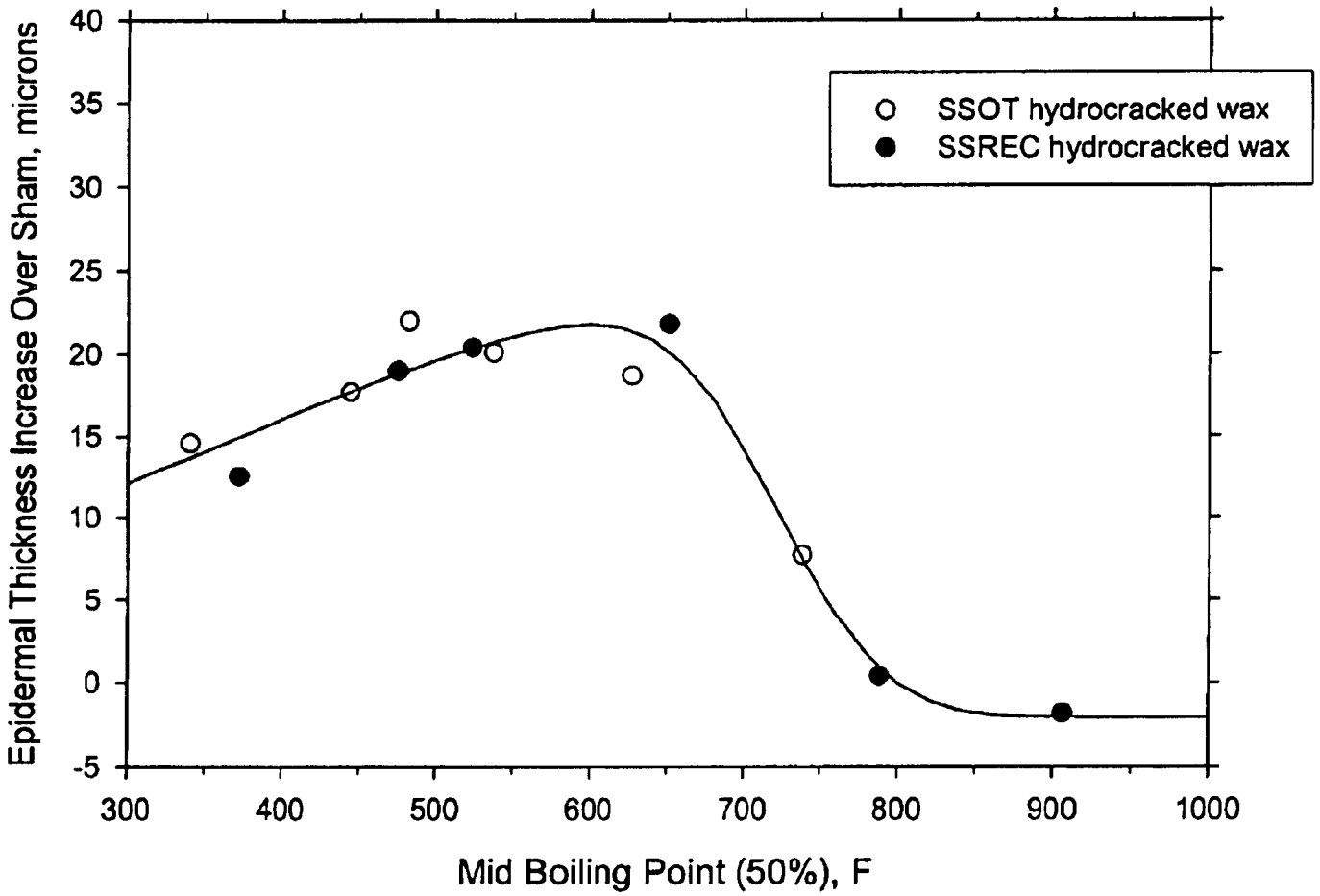
FIG. 3 is a graph which plots the increase in epidermal thickness observed in mice against mid-boiling range of various Fischer-Tropsch fuel samples.

Effect on Mouse Epidermal Thickness of Increasing Mid Boiling Point of Fischer-Tropsch Fuel Fischer-Tropsch hydrocarbons boiling within the range of transportation fuels having a range of different mid boiling points were prepared. The fuels were prepared by hydrocracking Fischer-Tropsch wax in single-stage once through (SSOT) and single-stage recycle (SSREC) mode using Pt/SAPO-11 catalyst at 1000 psig total pressure. The fuels had mid boiling points (at the 50 weight percent) by ASTM D2887 simulated distillation that ranged from about 340 degrees F. to 906 degrees F. Mice were treated with the various fuels according to the protocol that is given in Example 1. The results of the mouse tests are shown in FIG. 3. Each point on the graph represents the average epidermal thickness increase from all mice in a treatment group compared to the sham group. FIG. 3 shows an epidermal thickness increase (over sham) in the range of 12–15 microns in the mice dosed with fuels having a midpoint of about 350 degrees F. For fuels having a mid point approaching 600 degrees F. the epidermal thickness increase was about 20 microns. FIG. 3 also shows much less epidermal thickness increase from fuels having a mid point above about 700 degrees F. The mouse test results in FIG. 3 thus showed a greater increase in the mouse epidermal thickness (over the sham) for the fuels having a mid point between about 500 and 700 degrees F. than for fuels having either higher or lower mid points. Fuels having a midpoint above about 750 degrees F. resulted in little if any epidermal thickness increase.

Example 3

Effect on Mouse Epidermal Thickness of Carbon Number and Branching

Figure 4:
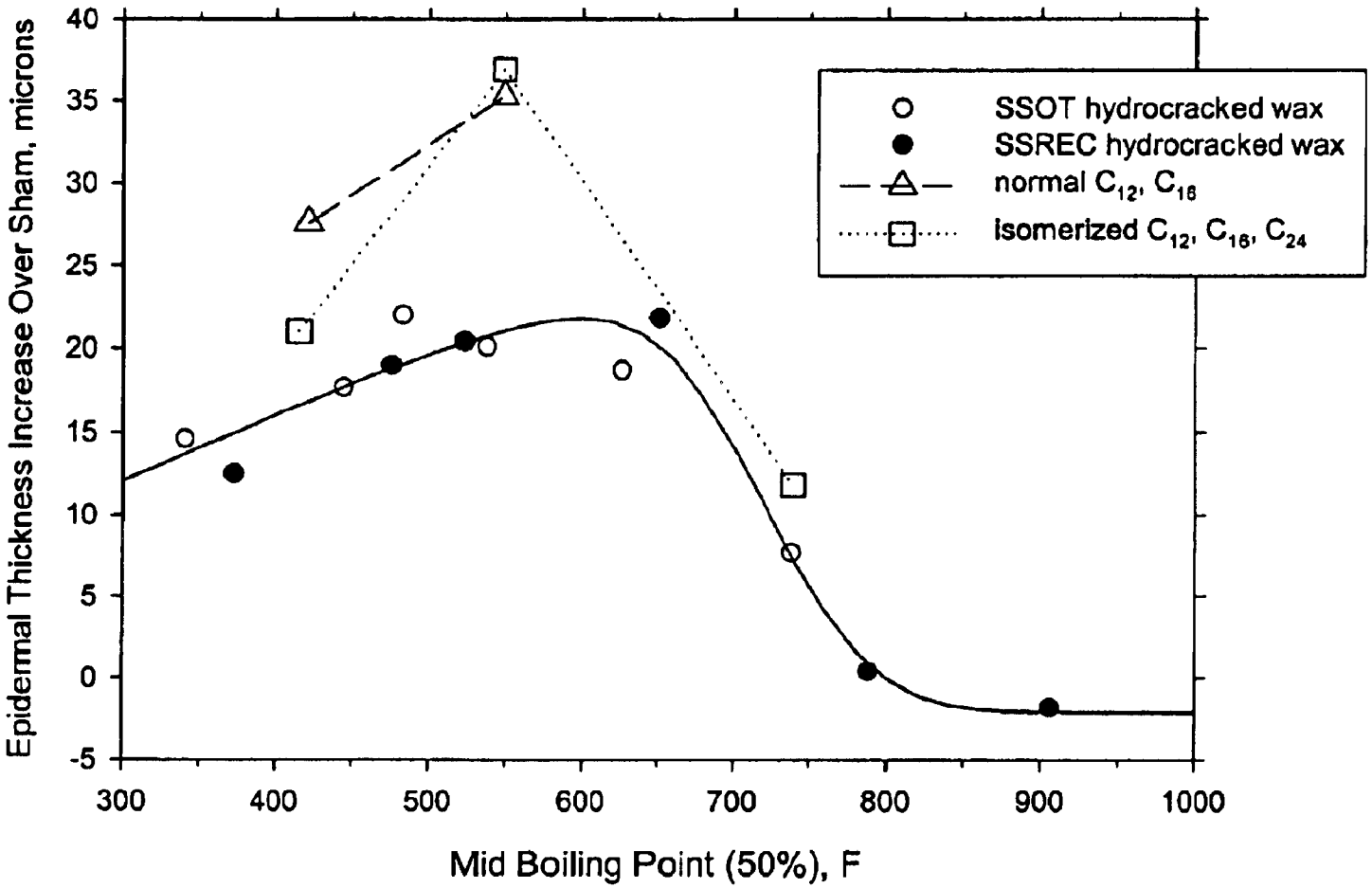
FIG. 4 has imposed on the plot of FIG. 3 the results of a test using pure compounds to illustrate the increase in mouse epidermal thickness when normal and isomerized compounds containing a known number of carbon atoms are compared.

Mouse tests using the protocol of Example 1 were performed using 5 different materials in order to determine the impact of carbon number on the mice as well as to determine the difference between straight chain and branched materials. The materials tested were n-$C_{12}$, n-$C_{16}$, isomerized $C_{12}$, isomerized $C_{16}$, and isomerized $C_{24}$. The three isomerized samples made by isomerizing n-$C_{12}$, n-$C_{16}$, n-$C_{24}$ over Pt/SAPO-11 catalyst at 1000 psig total pressure. The results for the mouse tests using the materials listed above are shown in FIG. 4. The results showed that the $C_{16}$ samples (n-$C_{16}$ and isomerized $C_{16}$) resulted in an epidermal thickness increase of about 35 to 37 microns over the sham. This increase was higher than the increase observed for the lower boiling materials, n-$C_{12}$ and isomerized $C_{12}$ (28 and 21 microns epidermal thickness increases, respectively) and the higher boiling isomerized $C_{24}$ (12 microns epidermal thickness increase). These results are consistent with the results of Example 2 and indicate that the materials having a midpoint between 500 and 700 degrees F. resulted in a greater increase in epidermal thickness than either the higher or the lower midpoint materials. The isomerized $C_{24}$ resulted in a substantially lower increase in epidermal thickness than the other samples in this example.

Example 4

Mouse Epidermal Thickness Increase from Wide Boiling Range Samples

Three sample fuels falling within the scope of the invention were prepared using Fischer-Tropsch derived materials. The samples had a very wide distribution of carbon numbers but relatively low levels of components that boil in the 500 to 700 degrees F. range. The boiling range distribution (in degrees F.) of the components present in each sample is shown in the table below.

| | | Weight Percent in each boiling range | | | | | | | | | | |
|---|---|---|---|---|---|---|---|---|---|---|---|---|
| | Mid Point | <400 | 400–450 | 450–500 | 500–550 | 550–600 | 600–650 | 650–700 | 700–750 | 750–800 | >800 | 500–700 F. |
| Sample | | | | | | | | | | | | |
| A | 584 | 18.2 | 8.3 | 8.5 | 8.9 | 9 | 8.2 | 7.5 | 6.4 | 5.9 | 19.1 | 33.6 |
| B | 627 | 14.6 | 7.4 | 7.6 | 8.0 | 8.2 | 7.8 | 7.5 | 6.8 | 6.7 | 25.4 | 31.5 |
| C | 665 | 12.2 | 6.6 | 6.8 | 7.1 | 7.7 | 7.5 | 7.3 | 7.3 | 7.4 | 30.2 | 29.6 |
| Comparative Samples | | | | | | | | | | | | |
| D | 482 | 27.9 | 13.7 | 13.4 | 14.4 | 14.7 | 13.7 | 2.2 | 0 | 0 | 0 | 45.0 |
| E | 475 | 28.8 | 13.8 | 14.2 | 14.7 | 15.1 | 13.3 | 0 | 0 | 0 | 0 | 43.1 |

Samples A and B were made using single-stage once through (SSOT) hydrocracking. Sample C was made using single-stage recycle (SSREC) hydrocracking. Mice were treated with the materials listed above according to the protocol given in Example 1. Sample A resulted in an epidermal thickness increase over sham of 6.3 microns. Sample B resulted in an epidermal thickness increase over sham of 5.8 microns. Sample C resulted in an epidermal thickness increase over sham of 3.2 microns. Comparative Samples D and E, with substantially more material boiling in the 500–700 degree F. range, induced epidermal thickness increases of 22 and 19 microns, respectively. These results illustrate that a wide boiling fuel containing relatively low levels of 500–700 degree F. boiling material and an increased amount of 700 degrees plus material results in a low increase in mouse epidermal thickness.

Example 5

Mouse Tests showing BrdU Results for Fuels

Figure 5:
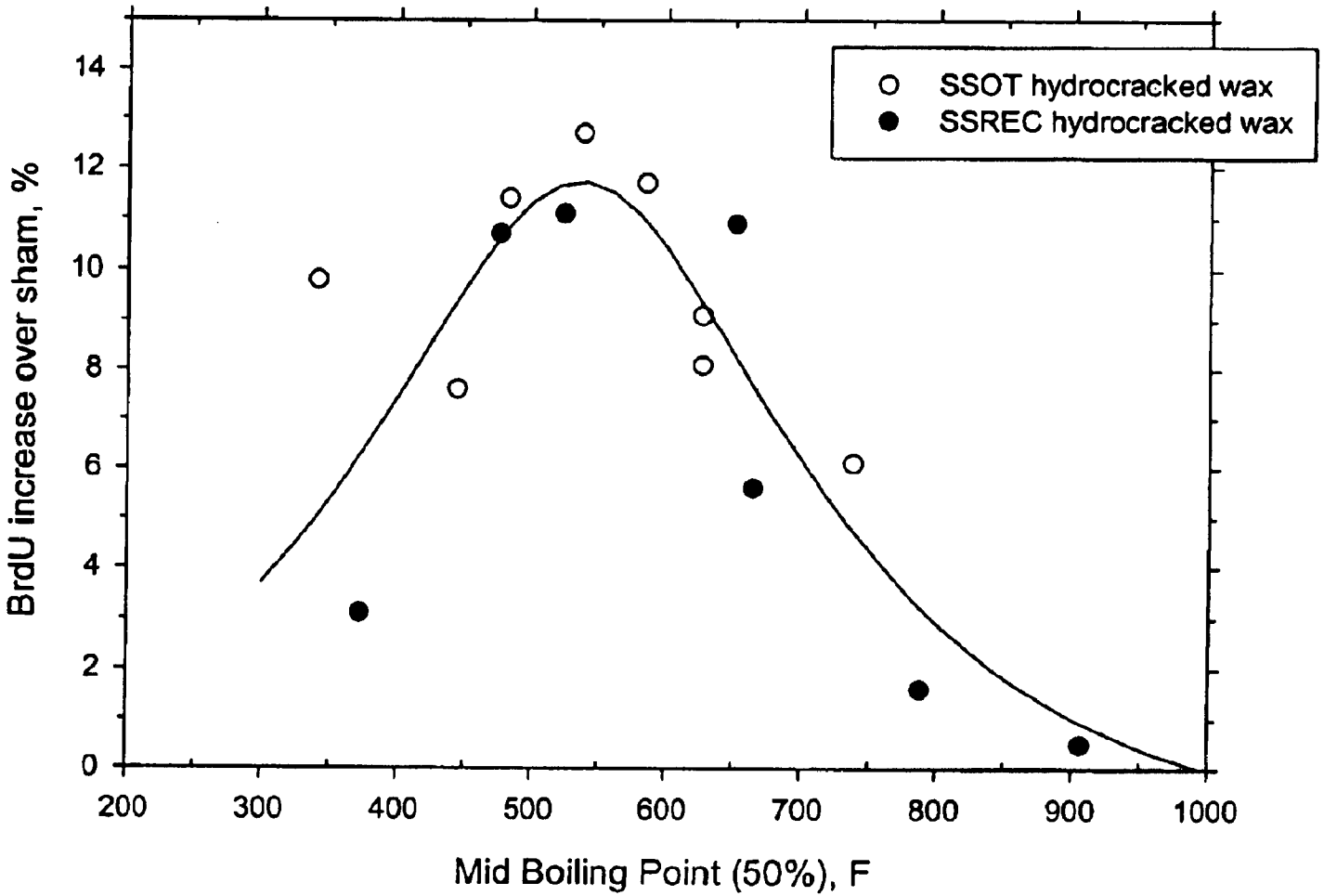
FIG. 5 is a graph which plots BrdU (5-bromo-2-deoxyuridine) increase versus mid-boiling range of various Fischer-Tropsch fuel samples.

The fuel samples that were used in Examples 2 and 4 were also tested to determine their effect on the incorporation of BrdU (5-bromo-2-deoxyuridine) into the mouse epidermal cells. The BrdU tests were performed using the protocol given in Example 1. The BrdU percent increase over sham are shown versus the Mid Point of the fuel samples in FIG. 5. The BrdU results are generally consistent with the mouse epidermal thickness results of Examples 2 and 4. The results indicate that Fischer-Tropsch fuel samples having a mid point in the 500–700 degree F. range result in greater BrdU increase in the mouse tests than fuels having a mid point above 700 degrees F.

What is claimed is:

1. A process for preparing a Fischer-Tropsch derived fuel composition suitable for use in a diesel engine which comprises:

(a) recovering a Fischer-Tropsch derived transportation fuel product;

(b) separating the Fischer-Tropsch derived transportation fuel product into at least a high boiling fraction, an intermediate boiling fraction, and a low boiling fraction, wherein the intermediate boiling fraction contains at least 70 weight percent of the hydrocarbons present in the Fischer-Tropsch derived transportation fuel product boiling between about 500 degrees F. and about 650 degrees F.; and (c) blending together the high boiling fraction and the low boiling fraction whereby a Fischer-Tropsch derived transportation fuel composition characterized by a bi-modal boiling range distribution is produced that is suitable for use in a diesel engine.

2. The process of claim 1 wherein at least 70 weight percent of the intermediate boiling fraction boils within the range between about 400 degrees F. and about 650 degrees F.

3. The process of claim 2 wherein at least 90 weight percent of the intermediate boiling fraction boils within the range of from about 500 degrees F. and about 650 degrees F.

4. The process of claim 1 wherein the 5 weight percent of the low boiling fraction is at a temperature of about 570 degrees F. or less when measured by ASTM D2887 or its equivalent.

5. The process of claim 1 wherein the 95 weight percent point of the boiling range distribution for the high boiling fraction is at or above a temperature of about 630 degrees F. when measured by ASTM D2887 or its equivalent.

6. The process of claim 5 wherein the 95 weight percent point of the boiling range distribution for the high boiling fraction is at or above a temperature of about 680 degrees F. when measured by ASTM D2887 or its equivalent.

7. A Fischer-Tropsch derived fuel composition characterized by a boiling range distribution when measured by ASTM D2887 or its equivalent wherein the 5 weight percent point is at a temperature of 570 degrees F. or less and the 95 weight percent point is at or above a temperature of 630 degrees F.; a bi-modal boiling range distribution wherein less than 30 weight percent of the fuel boils between 400 degrees F. and 650 degrees F.; a kinematic viscosity at 40 degrees C. of less than 5.5 cSt; and a cloud point of less than −18 degrees C.

8. The fuel composition of claim 7 wherein the temperature of the 95 weight percent point of the boiling range distribution is above about 680 degrees F.

9. The fuel composition of claim 8 wherein the temperature of the 95 weight percent point of the boiling range distribution is above about 730 degrees F.

10. The fuel composition of claim 9 wherein the temperature of the 95 weight percent point of the boiling range distribution is above about 850 degrees F.

* * * * *